US011713213B2

(12) United States Patent
Stam

(10) Patent No.: US 11,713,213 B2
(45) Date of Patent: Aug. 1, 2023

(54) APPARATUS FOR TRANSPORTING A LOAD FROM A FIRST TO A SECOND LEVEL, IN PARTICULAR A STAIRLIFT

(71) Applicant: OTOLIFT TRAPLIFTEN B.V., Bergambacht (NL)

(72) Inventor: Michel Alexander Stam, Bergambacht (NL)

(73) Assignee: OTOLIFT TRAPLIFTEN B.V., Bergambacht (NL)

( * ) Notice: Subject to any disclaimer, the term of this patent is extended or adjusted under 35 U.S.C. 154(b) by 0 days.

(21) Appl. No.: 17/918,502

(22) PCT Filed: Apr. 22, 2021

(86) PCT No.: PCT/EP2021/060562

§ 371 (c)(1),
(2) Date: Oct. 12, 2022

(87) PCT Pub. No.: WO2021/219488

PCT Pub. Date: Nov. 4, 2021

(65) Prior Publication Data

US 2023/0145802 A1 May 11, 2023

(30) Foreign Application Priority Data

Apr. 29, 2020 (NL) ..... 2025457

(51) Int. Cl.
*B66B 9/08* (2006.01)

(52) U.S. Cl.
CPC ..... *B66B 9/08* (2013.01)

(58) Field of Classification Search
CPC ..... B66B 9/08; B66B 9/0838
See application file for complete search history.

(56) References Cited

U.S. PATENT DOCUMENTS 2,888,099 A * 5/1959 Hoffmann ..... B66B 9/0838 187/202
5,720,364 A * 2/1998 Glover ..... B66B 9/0838 187/245

(Continued)

FOREIGN PATENT DOCUMENTS

EP 3326955 A1 5/2018
EP 3747817 A1 12/2020

OTHER PUBLICATIONS

International Search Report and Written Opinion, dated Jun. 25, 2021, for Application No. PCT/EP2021/060562 (11 pages).

(Continued)

*Primary Examiner* — Michael A Riegelman
(74) *Attorney, Agent, or Firm* — KDW Firm PLLC

(57) ABSTRACT

Apparatus for transporting a load from a first to a second level includes means for maintaining the load carrier in a predetermined rotational position. The means includes a motor to rotate the load carrier relative to the frame. The apparatus includes an emergency rotation blocking arrangement having a first braking member rigidly connected to the frame or load carrier, a second braking member rigidly connected to the other of the frame and load carrier, a third braking member between the first and second braking members, and a movable retaining member which holds the third braking member and is movable relative to the second braking member. In braking mode the retaining member moves relative to the second braking member to move the third braking member to engage the primary and secondary braking surface and block rotation of the second braking member in a tangential direction relative to the first braking member.

12 Claims, 6 Drawing Sheets

(56) References Cited

U.S. PATENT DOCUMENTS

| | | | | |
|---|---|---|---|---|
| 8,087,495 | B2 * | 1/2012 | Szentistvany | B66B 9/0815 187/202 |
| 9,751,725 | B2 * | 9/2017 | Hall | B66B 9/0853 |
| 10,479,649 | B2 * | 11/2019 | Colenutt | B66B 9/0815 |
| 10,519,002 | B2 * | 12/2019 | Cook | B66B 1/30 |
| 11,261,060 | B2 * | 3/2022 | Woodhams | B66B 9/0838 |
| 11,603,287 | B2 * | 3/2023 | Pratt, IV | B66B 5/044 |
| 2005/0279580 | A1 * | 12/2005 | Szentistvany | B66B 9/0815 187/201 |
| 2007/0235265 | A1 * | 10/2007 | Vroegindeweij | B66B 9/0838 187/201 |
| 2010/0274409 | A1 * | 10/2010 | Smith | B66B 9/0838 700/304 |
| 2017/0001837 | A1 * | 1/2017 | Hall | B66B 9/0853 |
| 2017/0144860 | A1 * | 5/2017 | Colenutt | B66B 5/044 |
| 2017/0158464 | A1 * | 6/2017 | De Kroon | B66B 9/08 |

OTHER PUBLICATIONS

International Preliminary Report on Patentability, dated Oct. 27, 2022, for Application No. PCT/EP2021/060562 (seven (7) pages).

* cited by examiner

APPARATUS FOR TRANSPORTING A LOAD FROM A FIRST TO A SECOND LEVEL, IN PARTICULAR A STAIRLIFT

This application is a national stage filing under 35 U.S.C. 371 of pending International Application No. PCT/EP2021/060562, filed Apr. 22, 2021, which claims priority to Netherlands Patent Application No. 2025457, filed Apr. 29, 2020, the entirety of which applications are incorporated by reference herein.

The invention relates to an apparatus for transporting a load from a first to a second level, in particular a stairlift, comprising:

- a frame which is displaceable along a rail and which is provided with support, guide and drive means arranged to engage the rail,
- a load carrier which is rotationally mounted on said frame to be rotated around a horizontal axis, and
- means for maintaining the load carrier in a predetermined rotational position relative to the direction of gravity, which position-maintaining means comprise at least one adjusting motor arranged to rotate the load carrier relative to the frame around said horizontal axis,
- wherein said apparatus further comprises an emergency rotation blocking arrangement for preventing said rotation between the load carrier and said frame, said rotation blocking arrangement comprising:
- a first braking member rigidly connected to one of said frame and said load carrier,
- a second braking member rigidly connected to the other one of said frame and said load carrier,
- at least one third braking member arranged between said first braking member and said second braking member,
- a movable retaining member which holds said third braking member and which is arranged to be moved relative to the second braking member;
- wherein said first braking member has a primary braking surface which is strip shaped and extends along at least a section of a circle around said axis,
- wherein said second braking member has at least one secondary braking surface which extends at a distance from said primary braking surface at an angle in such a manner that the distance between the two surfaces varies, thereby forming a substantially wedge shaped gap between the primary surface and the secondary surface having a wider part and a narrower part, the wedge shaped gap widening in a tangential direction around said axis,
- wherein in a normal operation mode said third braking member is held in a fixed position relative to said second braking member by said retaining member such that it extends in the wider part of said wedge shaped gap where it cannot engage both the primary braking surface and the secondary braking surface at the same time, and
- wherein in a braking operation mode said retaining member is arranged to be moved relative to said second braking member such that said third braking member moves to the narrower part of said wedge shaped gap, thereby engaging both the primary braking surface and the secondary braking surface and blocking rotation of the second braking member in said tangential direction relative to the first braking member.

Such an apparatus is described in EP 3 326 955 A. The emergency blocking mechanism prevents the carrier from uncontrolled rotational movement should the means for maintaining the carrier in the predetermined rotational position fail, in particular to prevent injuries to person sitting on the carrier.

The invention aims at an alternative reliable emergency blocking solution.

To that end said movable retaining member is designed such that it forces the third braking member to move to the narrower part of said wedge shaped gap when the retaining member is moved relative to said second braking member in said braking operation mode.

Preferably in the normal operation mode the third braking member in said fixed position is being held away from the primary braking surface by a surface of a guide.

Preferably said retaining member is at least partially made of a flexible material or has an otherwise flexible structure which allows the at least one third braking member to be moved by engagement of the first secondary braking surface and the second secondary braking surface without the retaining member being driven to move said third braking member.

Preferably said second braking member comprises at least two secondary braking surfaces, being at least one first secondary braking surface and at least one second secondary braking surface, said at least one first secondary braking surface forming a first substantially wedge shaped gap widening in a first tangential direction around said axis, and said at least one second secondary braking surface forming a second substantially wedge shaped gap widening in a second tangential direction around said axis, said second tangential direction being the opposite of said first tangential direction, and said at least one third braking member being forced by said retaining member in said braking operation mode to move to a narrower part of one of said first and second substantially wedge shaped gaps, thereby forcing said at least one third braking member to block rotation of the second braking member in either tangential direction relative to the first braking member.

Preferably said at least first secondary surface and said at least second secondary braking surface form two separate substantially wedge shaped gaps, and said at least one third braking member are at least two separate third braking members, each extending in a respective substantially wedge shaped gap.

Preferably said blocking arrangement comprises a multitude of first and secondary braking surfaces forming substantially wedge shaped gaps and a multitude of third braking members, each extending in a respective substantially wedge shaped gap.

Preferably said retaining member is at least partially made of a flexible material or has an otherwise flexible structure which allows the multitude of third braking members to be moved relative to each other by engagement of the first secondary braking surface and the second secondary braking surface.

Preferably said primary braking surface is a cylindrical surface.

Preferably said at least one third braking member has the form of a cylinder, and the axis of said cylinder extends parallel to both the primary and secondary braking surfaces.

Preferably said retaining member is held in position in normal operation by the force of an electrically powered electromagnet.

Preferably a resilient biasing member is arranged to move said retaining member from said fixed position in normal operation mode to said braking operation mode.

Preferably said first braking member is rigidly connected to said load carrier and said second braking member is rigidly connected to said frame.

The invention will now be elucidated by means of a preferred embodiment as shown in the figures, wherein:

FIG. 2 shows an exploded perspective view of a displaceable frame and a carrier for a stairlift as shown in FIG. 1, with an emergency rotation blocking arrangement mounted there between;

Figure 1:
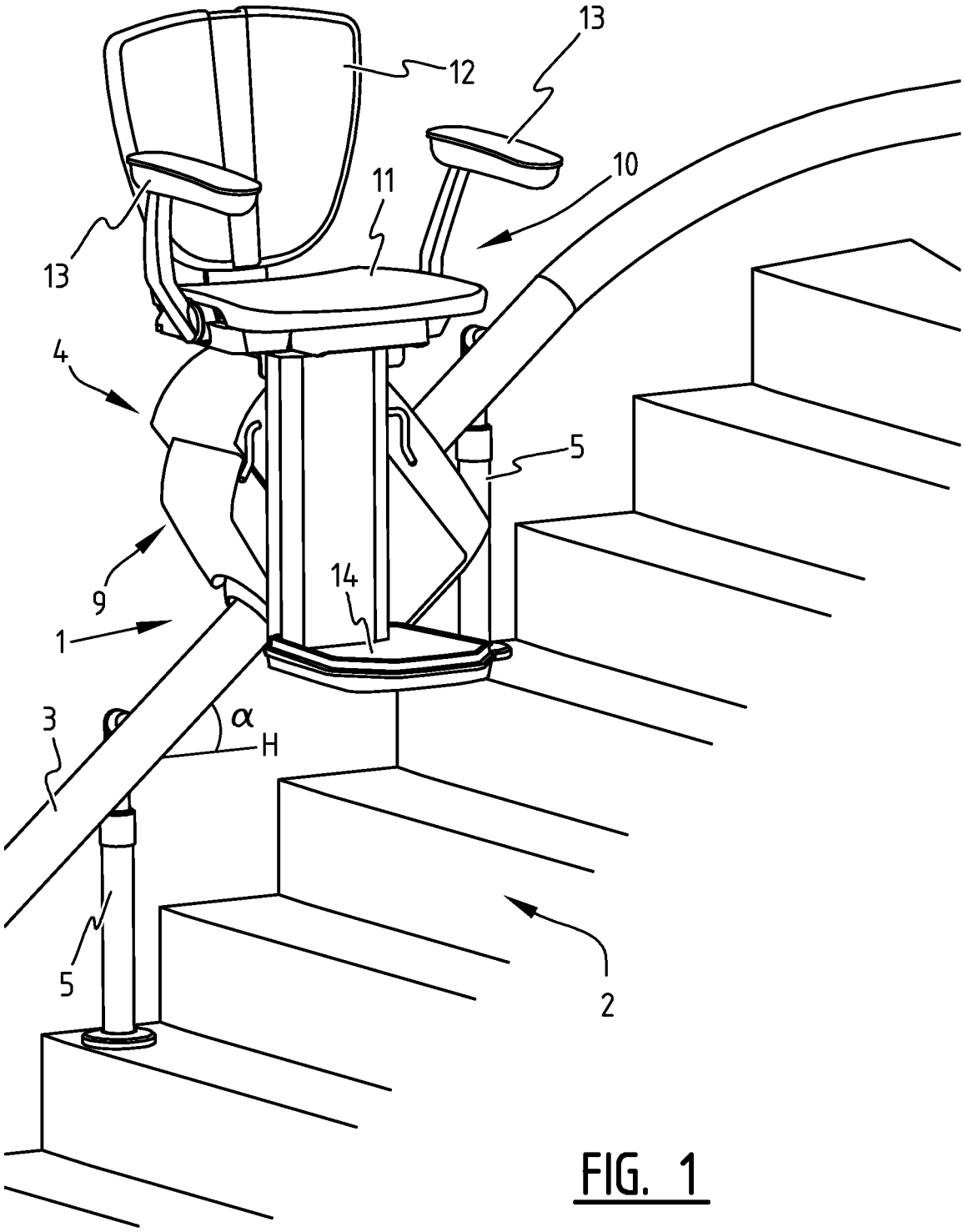
FIG. 1 shows a perspective view of an exemplary embodiment of a stairlift.

FIG. 1 shows an system 1 for transporting a load from a first to a second level, in the shown embodiment a stairlift system, which comprises a rail 3 which is placed along a staircase 2 and which encloses an angle $\alpha$ with the horizontal H, and an apparatus 4 movable along rail 3 for transporting the load between the different levels. Rail 3, which in the shown embodiment has a round cross-section, is supported by a number of posts 5 which are arranged distributed along staircase 2 and which are fixed to a protruding part extending along rail 3. Rail 3 is further provided with a propelling part in the form of a gear rack. Stairlift 4 comprises a frame 9 which is displaceable along rail 3 and on which a load carrier 10 is mounted, here in the form of a chair with a seat 11, back rest 12, armrests 13 and a footrest 14. Chair 10 is connected to frame 9 by a rotatable shaft 15 and fixation means 16, 17 (shown in FIG. 2) for rotating around a horizontal axis, and arranged in frame 9 and carrier 10 is a level maintaining mechanism consisting of, among other parts, of an adjusting motor connected to said shaft 15 so that the position of chair 10 can be kept constant at all times irrespective of the inclination of rail 3. For further details of an embodiment of a system as shown here, reference is made to European patent application publication EP 2 216 284 A1, which is incorporated herein by reference. This description will hereafter focus on the new emergency rotation blocking arrangement between the frame 9 and the load carrier 10.

Figure 2:
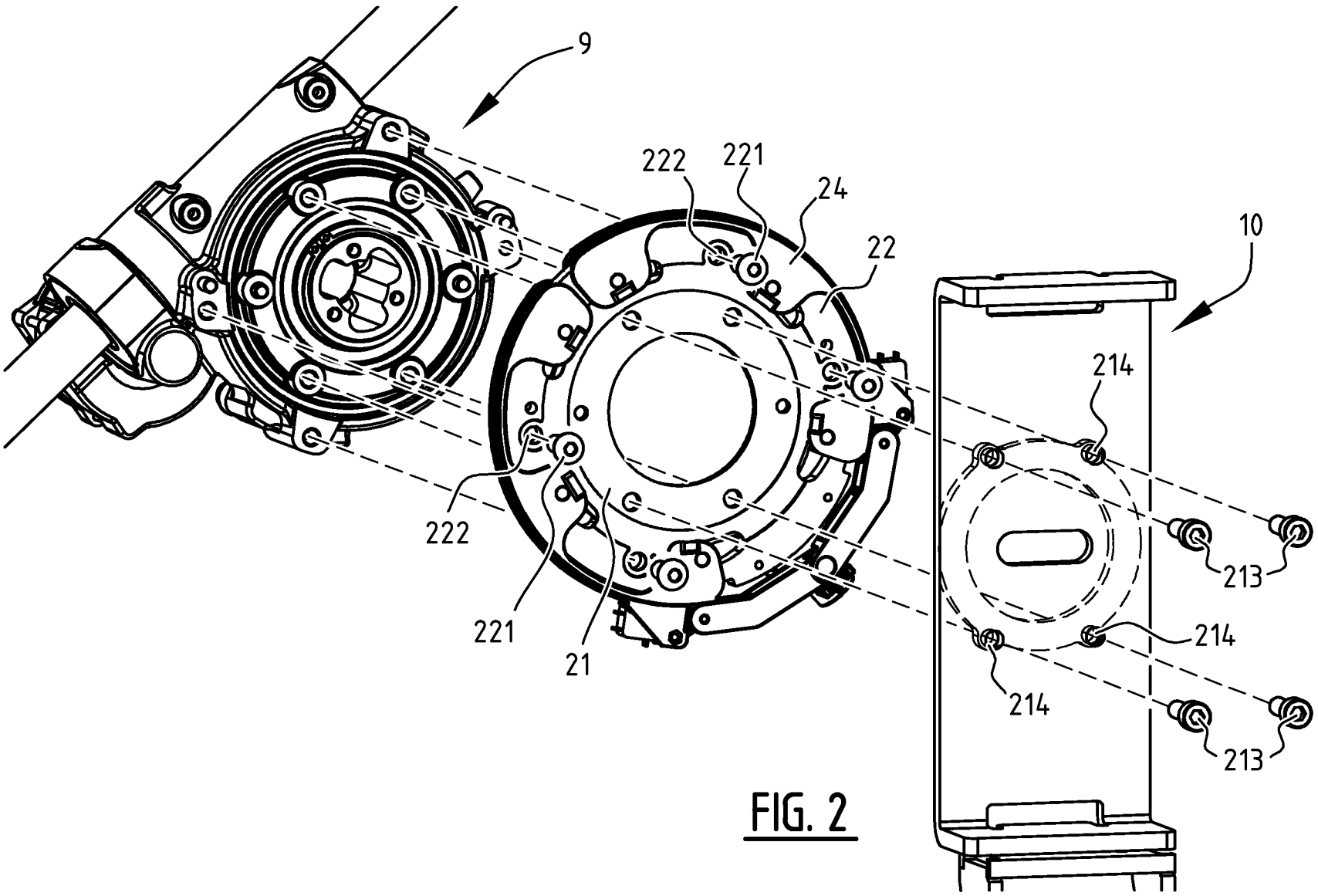
Figure 3:
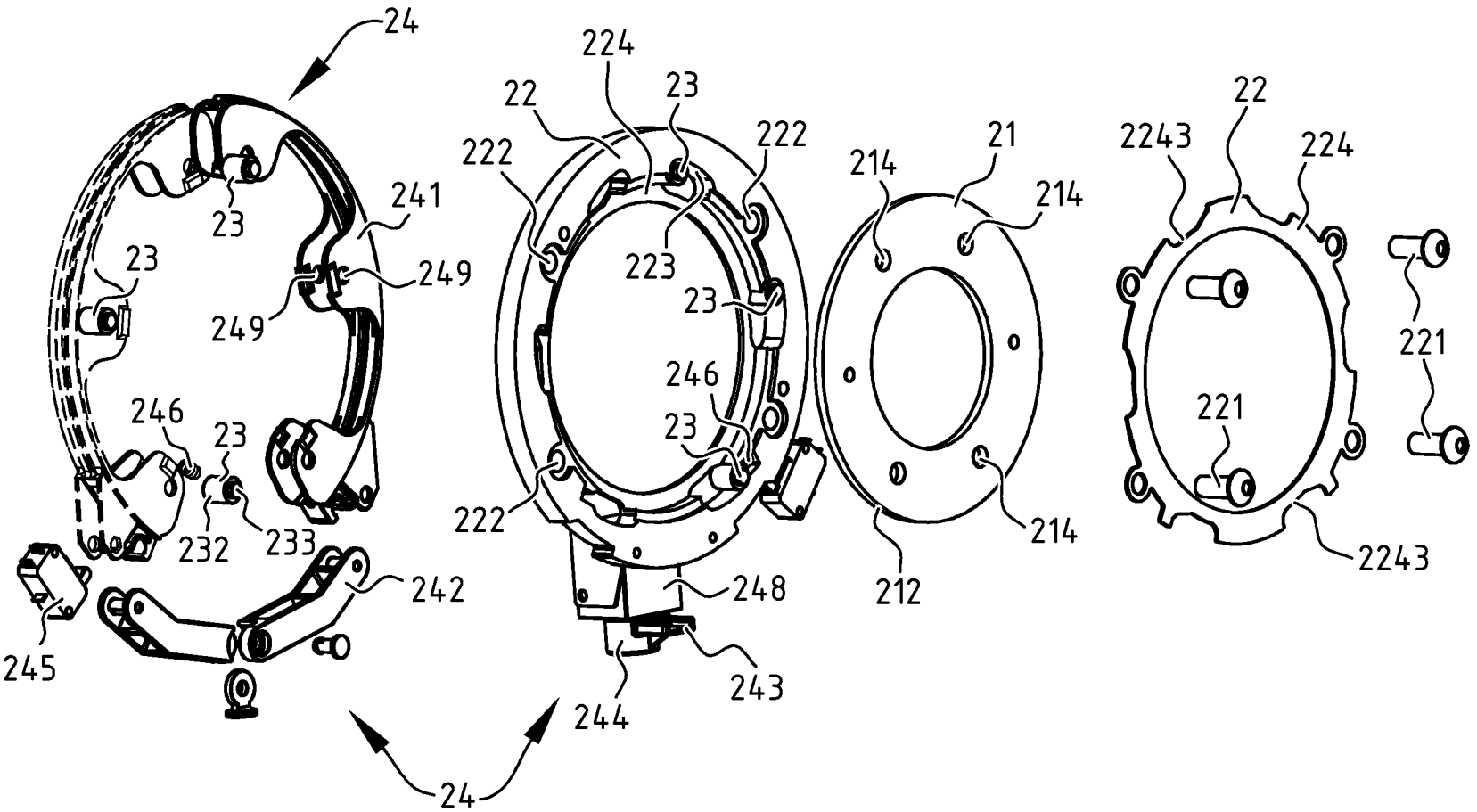
FIG. 3 shows an exploded perspective view of the emergency rotation blocking arrangement of FIG. 2.

According to FIGS. 2 and 3, an emergency rotation blocking arrangement is mounted between a frame 9 and a load carrier 10. The rotation blocking arrangement comprises a first braking member 21, a second braking member 22, a plurality of third braking members 23, and a retaining member 24 for holding the third braking members 23 in position.

The first braking member 21 comprises a cylindrical outer surface 212 extending around the hollow shaft 15. The first braking member 21 is rigidly connected to the load carrier 10 by bolts 213 extending through holes 214 in said body 10.

The second braking member 22 comprises a substantially cylindrical body extending around the cylindrical part 212 of the first braking member 21, such that it can rotate relative thereto. The second braking member 22 is rigidly connected to the frame 9 by bolts 221 extending through holes 222. A guide ring 224, which encloses the first braking member 21 in the axial direction, is provided on each side of the second braking member 22.

Figure 4:
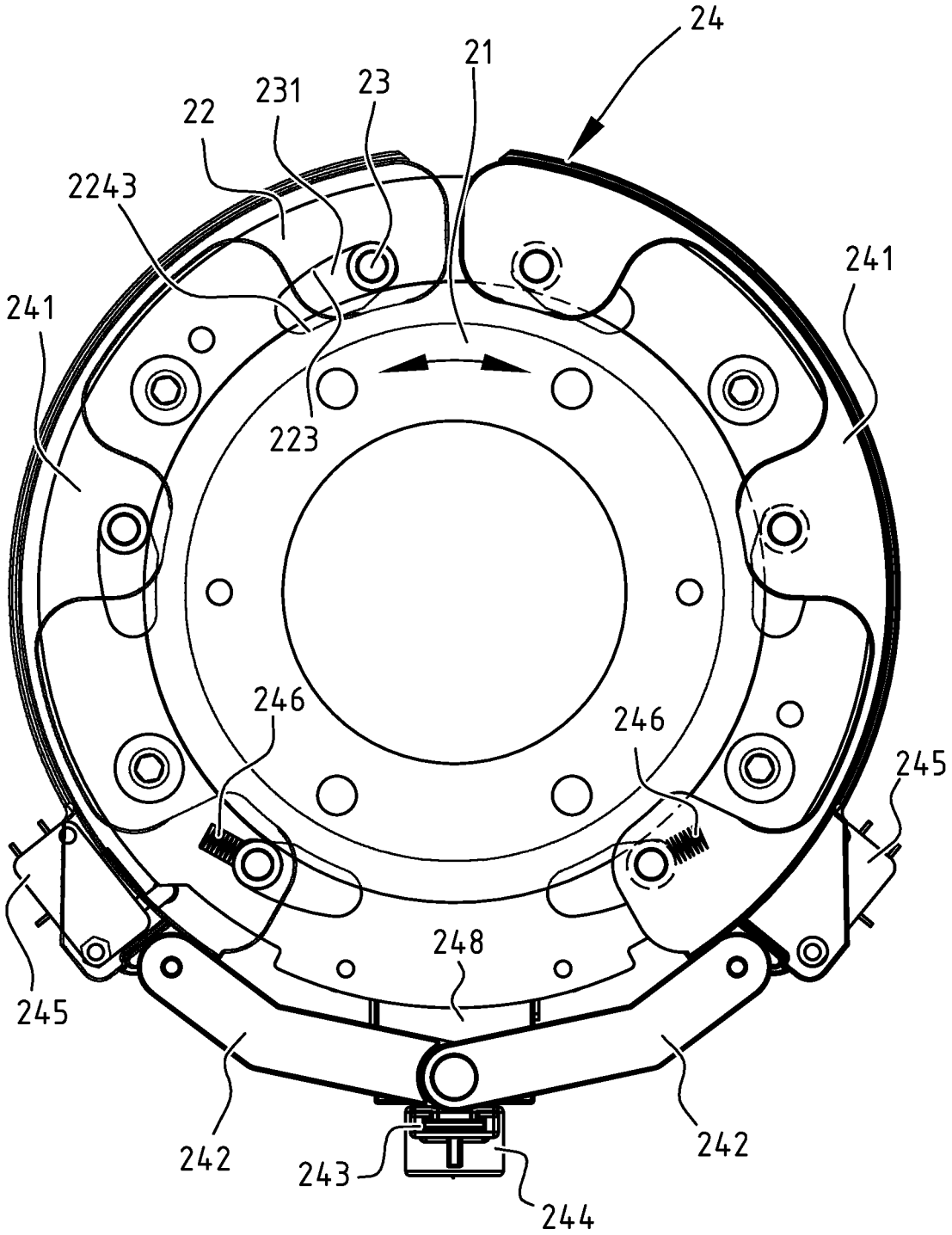
FIGS. 4, 5 and 6 show a front view of the emergency rotation blocking arrangement of FIG. 3 in normal operation mode, resting or non-operational mode, and in braking operation mode respectively.
Figure 5:
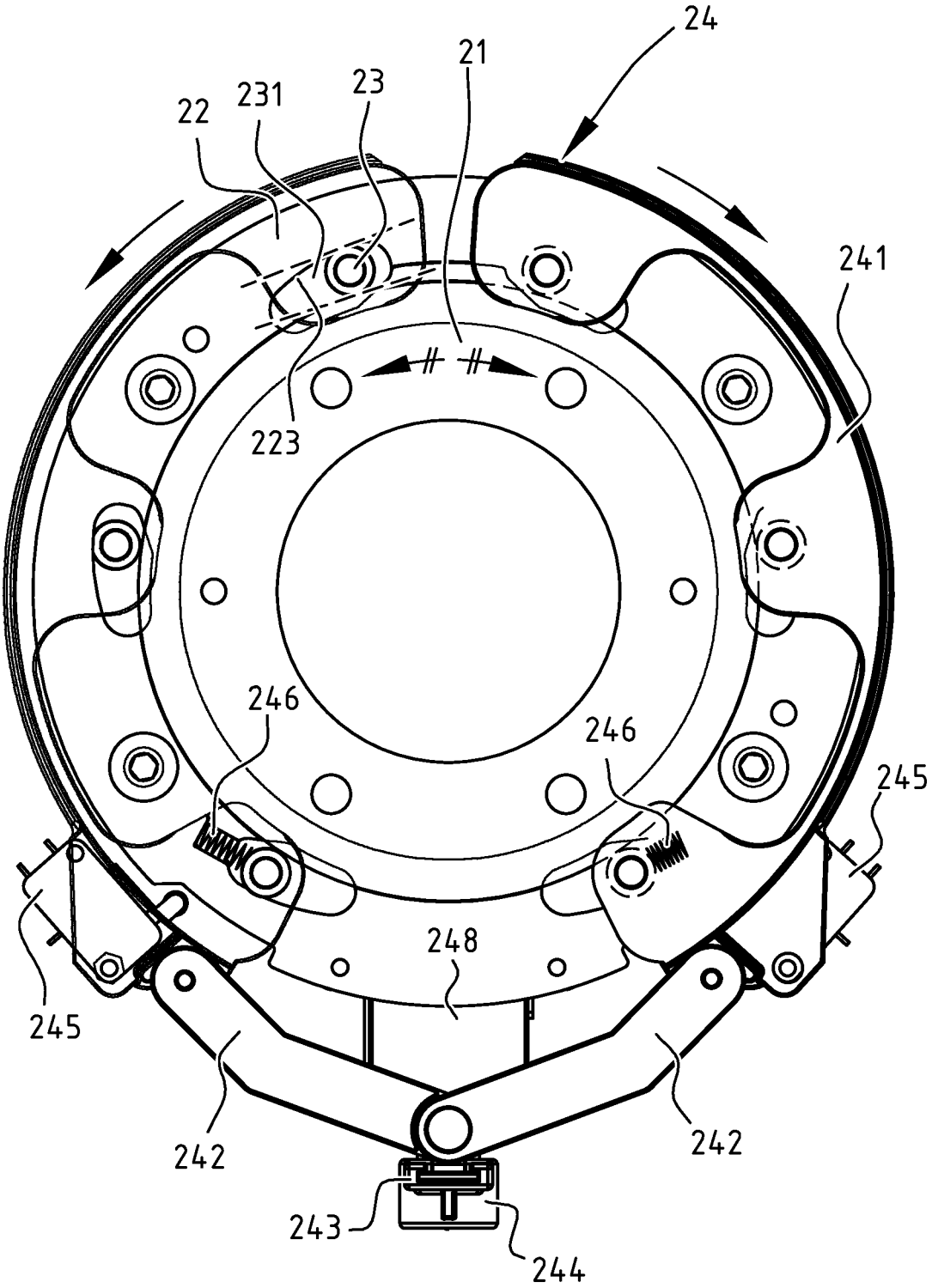
Figure 6:
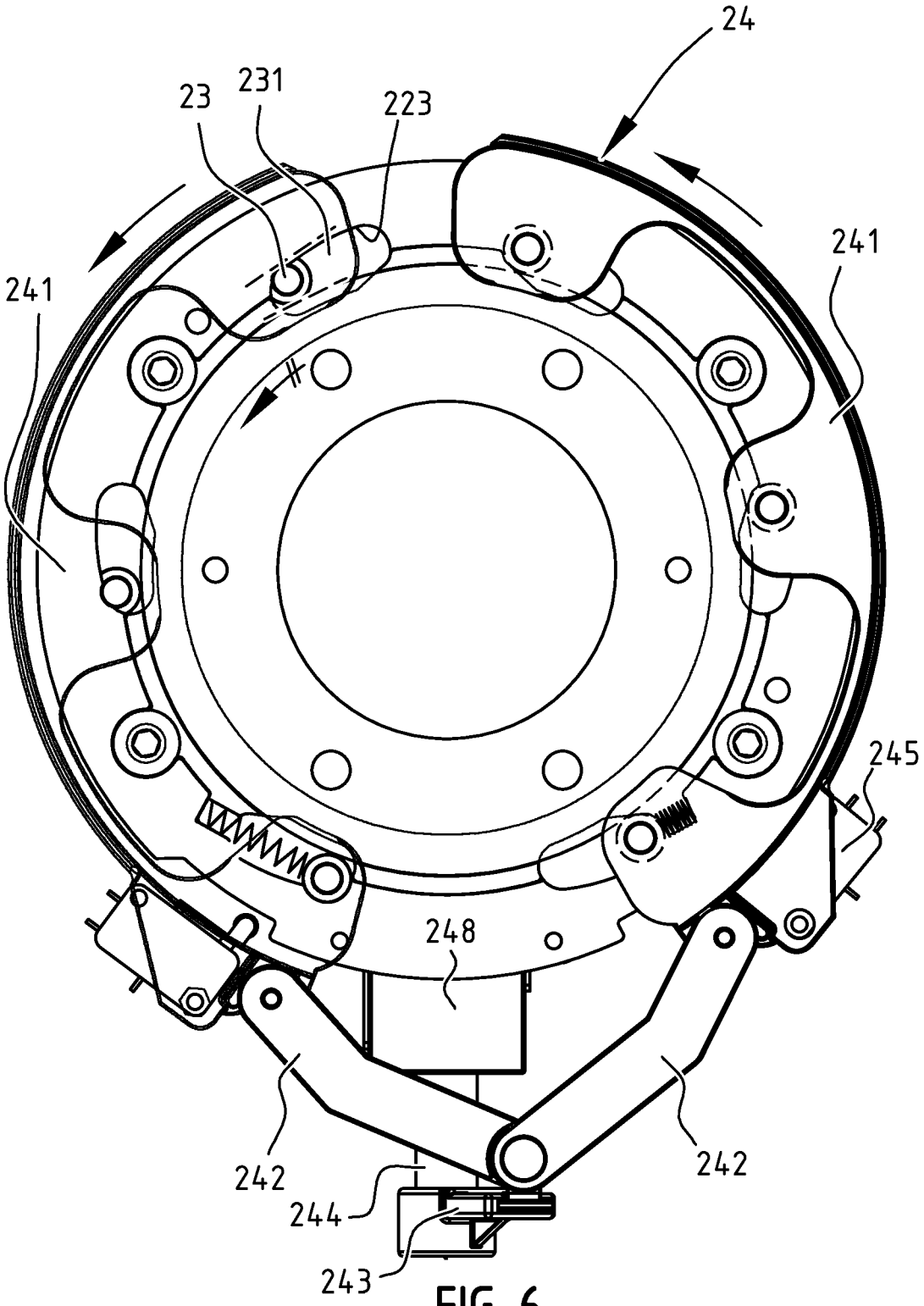

The second braking member 22 comprises recesses 223 in its inner circumferential wall around the cylindrical outer surface 212 of the first braking member 21, such that the surface of said recesses face the outer surface 212. As shown in FIGS. 4, 5 and 6, the surface of the recesses 223 is shaped such that the surface of each recess 223 and said surface of the cylindrical part 212 form substantially wedge shaped gaps 231, having a wider part in its upper region and a narrower part in its lower region. The guide ring 224 of the braking member 22 has a substantially circular shape, and comprises recesses which form guides 2243 that are shaped such that can they engage both outer ends of the third braking members 23 and guide the third braking members 23 away from the surface 212 when they are moved by the retaining member 24 to the upper extreme positions, as shown in FIG. 4 and as explained below.

The third braking members 23 have a cylindrical main body 232 and a shaft 233 extending from both ends. The holders 241 of the retaining member 24 have holes 249 in which the shafts 233 of the third braking members 23 extend. The braking members 23 can freely rotate around the shafts 233.

The retaining member 24 comprises two holders 241, two lateral arms 242, a link 243 and a shaft 244. The shaft 244 is mounted on the load carrier 10 in such a manner that it can move in its axial direction, which direction is perpendicular to the horizontal axial direction of the first braking member 21 and the second braking member 22, and which axial direction is, in the embodiment as shown, the vertical direction. The link 243 is attached to the shaft 244 and extends perpendicular to the shaft and is allowed to rotate around the axis of the shaft 244. One end of each of the two lateral arms 242 is attached to the outer end of the link 243 in such a manner that they can rotate around a horizontal axis which is parallel to the horizontal axial direction of the first braking member 21 and the second braking member 22, and such that they can rotate about an axis which is parallel to said axis of the shaft 244. The other outer ends of the lateral arms 242 are each attached to a respective holder 241, in such a manner that the holders 241 can rotate with respect to the arms 242 about an axis which is parallel to the horizontal axial direction of the first braking member 21 and the second braking member 22.

The holders 241 are made of a flexible material, such as a flexible plastic material, such that they can easily deform when forces are exerted on different parts of the holder 241, in particular by the third braking members 23.

Detectors such as micro switches 245 detect the angular mutual orientation between the arms 242 and the holders 241, whereby an emergency braking action may be detected, such that the stairlift may be put out of operation until maintenance has occurred.

The shaft 244, the holders 241 and the third braking members 23 that they hold are movable between two respective extreme positions. Two or more biased springs 246 may be provided, of which one end pushes against a third braking member 23, one on the right side and one the left side as seen in the FIGS. 4-6, and the other end pushes against a stop surface in the recess 223 of the second braking member 22, thereby pushing said third braking member 23 and thereby the retaining member 24, that hold all third braking members 23, towards their first extreme position. Furthermore an electromagnet 248 is provided, which is mounted on the load carrier 10. When, in the normal operation mode, the electromagnet 248 is powered, it pulls the shaft 244 of the retaining member 24 in its second extreme (upper) position, against the force of spring 246, thereby moving the holders 241 of the retaining member 24 and the third braking members 23 towards their second extreme position. If the electromagnet is not powered, the shaft 244 is allowed to move, and the spring 246 may push the holders 241 of the retaining member 24 and the third braking members 23 back towards their first extreme position.

In the normal operation mode, as shown in FIG. 4, when the retaining member 24 is forced to be in the upper position by the electromagnet 248, and the retaining member 24 carry the shafts 233 of the third braking members 23 such that their main bodies 232 are forced to extend in the wider parts of the wedge shaped gaps 231 and the third braking members are (just) lifted from the surface 212 by the guides 2243. In that position the first braking member 21 and the second braking member 22, and thereby the frame 9 and the load carrier 10, can freely rotate relative to each other.

As shown in FIG. 5, in a resting or non-operational mode when the stairlift is not moving, the electromagnet is unpowered, and the retaining member 24 with the holders 241 is forced towards the lower position by the spring 246, whereby the shafts 233 of the third braking members 23 move towards the narrower part of the wedge shaped gaps 231 at both the left and right sides of FIG. 5, such that the of the cylindrical surfaces of the main bodies 232 of the third braking members 23 each touch both the surface 212 of the first braking member 21 and the surface 223 of the second braking member 22. In that position the friction of the main bodies 232 of the third braking members 23, prevents rotation between the first braking member 21 and the second braking member 22, and thereby the frame 9 and the load carrier 10.

In the emergency braking operation mode the electromagnet is also unpowered, for instance in reaction to a signal from a sensor that detects tilting of the load carrier, and the retaining member 24 with the holders 241 is first forced towards the lower position by the spring 246, as in the resting mode of FIG. 5, whereby the shafts 233 of the third braking members 23 move to the narrower part of the wedge shaped gaps 231 at both the left and right sides. However, due to (undesired) rotation of the load carrier 10 and the first braking member 21 attached to it, the third braking members 23 at either the left or the right side (depending on the direction of rotation of the first braking member 21) will move further into the narrow side of the gap, which may cause deformation of the materials of for instance the second braking member (as shown in FIG. 6).

Said movement of the third braking members will cause their holder 241 to move and thereby also move the other holder 241 of the retaining member 24 with the other third braking members 23 as shown in FIG. 6. In that position the friction of the main bodies 232 of the third braking members 23, and the possible deformation of materials, prevent rotation between the first braking member 21 and the second braking member 22, and thereby the frame 9 and the load carrier 10. Thereby the undesired rotation of the load carrier 10 is stopped.

The flexibility of the holders 241 allow that in the braking operation mode all the third braking members 23 in the respective holder can and will be engaged by the surface 212 of the first braking member 21 and the respective surfaces 223 of the second braking member 22, as they are not necessarily held in a mutually fixed position as would be the case with a stiff retaining member.

The invention has thus been described by means of a preferred embodiment. It is to be understood, however, that this disclosure is merely illustrative. Various details of the structure and function were presented, but changes made therein, to the full extent extended by the general meaning of the terms in which the appended claims are expressed, are understood to be within the principle of the present invention. The description and drawings shall be used to interpret the claims. The claims should not be interpreted as meaning that the extent of the protection sought is to be understood as that defined by the strict, literal meaning of the wording used in the claims, the description and drawings being employed only for the purpose of resolving any ambiguity found in the claims. For the purpose of determining the extent of protection sought by the claims, due account shall be taken of any element which is equivalent to an element specified therein.

The invention claimed is:

1. An apparatus for transporting a load from a first to a second level, in particular a stairlift, comprising:

a frame which is displaceable along a rail and which is provided with support, guide and drive means arranged to engage the rail, a load carrier which is rotationally mounted on said frame to be rotated around a horizontal axis, and means for maintaining the load carrier in a predetermined rotational position relative to the direction of gravity, which position-maintaining means comprise at least one adjusting motor arranged to rotate the load carrier relative to the frame around said horizontal axis, wherein said apparatus further comprises an emergency rotation blocking arrangement for preventing said rotation between the load carrier and said frame, said rotation blocking arrangement comprising:

a first braking member rigidly connected to one of said frame and said load carrier, a second braking member rigidly connected to the other one of said frame and said load carrier, at least one third braking member arranged between said first braking member and said second braking member, a movable retaining member which holds said third braking member and which is arranged to be moved relative to the second braking member;

wherein said first braking member has a primary braking surface which is strip shaped and extends along at least a section of a circle around said axis, wherein said second braking member has at least one secondary braking surface which extends at a distance from said primary braking surface at an angle in such a manner that the distance between the two surfaces varies, thereby forming a substantially wedge shaped gap between the primary surface and the secondary surface having a wider part and a narrower part, the wedge shaped gap widening in a tangential direction around said axis, wherein in a normal operation mode said third braking member is held in a fixed position relative to said second braking member by said retaining member such that it extends in the wider part of said wedge shaped gap where it cannot engage both the primary braking surface and the secondary braking surface at the same time, wherein in a braking operation mode said retaining member is arranged to be moved relative to said second braking member such that said third braking member moves to the narrower part of said wedge shaped gap, thereby engaging both the primary braking surface and the secondary braking surface and blocking rotation of the second braking member in said tangential direction relative to the first braking member, and wherein said movable retaining member is designed such that it forces the third braking member to move to the narrower part of said wedge shaped gap when the retaining member is moved relative to said second braking member in said braking operation mode.

2. The apparatus according to claim 1, wherein in the normal operation mode the third braking member in said fixed position is being held away from the primary braking surface by a surface of a guide.

3. The apparatus according to claim 1, wherein said retaining member is at least partially made of a flexible material or has an otherwise flexible structure which allows the at least one third braking member to be moved by engagement of the first secondary braking surface and the second secondary braking surface without the retaining member being driven to move said third braking member.

4. The apparatus according to according to claim 1, wherein said second braking member comprises at least two secondary braking surfaces, being at least one first secondary braking surface and at least one second secondary braking surface, said at least one first secondary braking surface forming a first substantially wedge shaped gap widening in a first tangential direction around said axis, and said at least one second secondary braking surface forming a second substantially wedge shaped gap widening in a second tangential direction around said axis, said second tangential direction being the opposite of said first tangential direction, and said at least one third braking member being forced by said retaining member in said braking operation mode to move to a narrower part of one of said first and second substantially wedge shaped gaps, thereby forcing said at least one third braking member to block rotation of the second braking member in either tangential direction relative to the first braking member.

5. The apparatus according to claim 4, wherein said at least first secondary surface and said at least second secondary braking surface form two separate substantially wedge shaped gaps, and said at least one third braking member are at least two separate third braking members, each extending in a respective substantially wedge shaped gap.

6. The apparatus according to according to claim 1, wherein said blocking arrangement comprises a multitude of first and secondary braking surfaces forming substantially wedge shaped gaps and a multitude of third braking members, each extending in a respective substantially wedge shaped gap.

7. The apparatus according to claim 6, wherein said retaining member is at least partially made of a flexible material or has an otherwise flexible structure which allows the multitude of third braking members to be moved relative to each other by engagement of the first secondary braking surface and the second secondary braking surface.

8. The apparatus according to according to claim 1, wherein said primary braking surface is a cylindrical surface.

9. The apparatus according to claim 1, wherein said at least one third braking member has the form of a cylinder, and the axis of said cylinder extends parallel to both the primary and secondary braking surfaces.

10. The apparatus according to according to claim 1, wherein said retaining member is held in position in normal operation by the force of an electrically powered electromagnet.

11. The apparatus according to according to claim 1, wherein a resilient biasing member is arranged to move said retaining member from said fixed position in normal operation mode to said braking operation mode.

12. The apparatus according to according to claim 1, wherein said first braking member is rigidly connected to said load carrier and said second braking member is rigidly connected to said frame.

* * * * *